US012642343B2

(12) United States Patent
Volatier

(10) Patent No.: US 12,642,343 B2
(45) Date of Patent: Jun. 2, 2026

(54) COSMETIC DISPENSER APPLICATOR

(71) Applicant: TEXEN, Brion (FR)

(72) Inventor: Sylvain Volatier, La Chapelle-Saint-Sauveur (FR)

(73) Assignee: TEXEN, Brion (FR)

( * ) Notice: Subject to any disclaimer, the term of this patent is extended or adjusted under 35 U.S.C. 154(b) by 170 days.

(21) Appl. No.: 18/638,051

(22) Filed: Apr. 17, 2024

(65) Prior Publication Data

US 2025/0031831 A1 Jan. 30, 2025

(30) Foreign Application Priority Data

Jun. 9, 2023 (FR) ..... 2305867

(51) Int. Cl.
*A45D 34/04* (2006.01)
*A45D 34/00* (2006.01)
*A45D 40/26* (2006.01)

(52) U.S. Cl.
CPC ..... *A45D 34/046* (2013.01); *A45D 2034/005* (2013.01); *A45D 34/045* (2013.01); *A45D 40/265* (2013.01); *A45D 40/267* (2013.01)

(58) Field of Classification Search
CPC ..... A45D 34/046; A45D 2034/005; A45D 34/045; A45D 34/047; A45D 40/267; A45D 40/265; A45D 40/268
USPC ..... 401/126–130
See application file for complete search history.

(56) References Cited

U.S. PATENT DOCUMENTS

| | | | | |
|---|---|---|---|---|
| 7,972,073 | B2 * | 7/2011 | Vintimiglia | A45D 40/267 401/129 |
| 11,445,798 | B2 * | 9/2022 | Brilland | A45D 40/265 |
| 11,666,132 | B2 * | 6/2023 | Lin | A46B 9/021 401/129 |
| 2006/0102192 | A1 | 5/2006 | Fischer et al. | |

FOREIGN PATENT DOCUMENTS

| | | | | |
|---|---|---|---|---|
| EP | 3300626 | A1 | 4/2018 | |
| FR | 2 920 650 | * | 7/2007 | A45D 40/26 |
| FR | 2920650 | A1 | 3/2009 | |
| FR | 2940026 | A1 | 6/2010 | |
| FR | 2982132 | A1 | 5/2013 | |
| FR | 3121664 | A1 | 10/2022 | |

* cited by examiner

*Primary Examiner* — David J Walczak
(74) *Attorney, Agent, or Firm* — Maier & Maier, PLLC

(57) ABSTRACT

A cosmetic product dispenser applicator includes a container including an externally threaded neck and a reservoir extending in an axial direction, provided with a lateral wall, an applicator of the cosmetic product, including a threaded head, a rod secured by its upper end to the head and by its lower end to an application element, a hollow outer shell including at least one opening and inside which the container is reversibly fastened, a hollow cover including at least one opening and inside which the applicator of the cosmetic product is reversibly fastened. The dispenser applicator having, respectively, outer and inner surfaces of the container and of the outer shell carry first complementary reversible fastening elements, in that the respective outer and inner surfaces of the applicator and of the cover carry second complementary reversible fastening elements.

10 Claims, 5 Drawing Sheets

COSMETIC DISPENSER APPLICATOR

FIELD

The invention concerns the field of cosmetics, and in particular a dispenser applicator intended to condition fluid or pasty products, for example mascaras or liquid lipsticks. The dispenser applicator according to the invention is more particularly designed for eye makeup.

BACKGROUND

A large number of documents are already known which disclose dispenser applicators of a fluid or pasty cosmetic product such as a mascara.

It is known from document EP 3 300 626 A1 a conditioning-sampling device for personal daily use and intended for conditioning, sampling, applying a material in fluid to pasty form. Such a device is sufficiently rigid as a whole to be able to be manipulated. It is most often of a general circular cylindrical shape with a main axis of extension.

The document FR 2 982 132 A1 describes in a particular embodiment a case with cladding, that is to say including one or several cladding elements, especially disposed around a reservoir element in order to hide it from view.

Document FR 2 920 650 A1 describes a dispenser applicator of a cosmetic product such as a mascara, of the clad and refillable type. It comprises a container with an externally threaded neck and a reservoir provided with a lateral wall delimiting a conditioning cavity, an applicator comprising a threaded rod to cooperate with the neck by screwing, a rod secured to the head and an application means, a hollow outer shell including an opening and inside which the container is reversibly fastened, as well as a cover including an opening and inside which the applicator is reversibly fastened.

Document US 2006/0102192 A1 describes a packaging for a cosmetic product such as a mascara, comprising an inner reservoir and an outer shell, disposed intertwined. The packaging is of the type with cladding, but not refillable. The reservoir and the shell are snapped into each other by the cooperation of a snap groove and a snap bead. Likewise, the cover and the head of the applicator are snapped into each other by the cooperation of recesses and projections. On the bottom of the shell, there is provided a simple centering device cooperating with the bottom of the reservoir.

Document FR 2 940 026 A1 concerns a refillable structure comprising a cladding, with a locking element, an anti-rotation device, as well as a base having axial projections for housing a bottle refill, and radial edges for connection between the base and the bottle container.

Document FR 3 121 664 A1 describes a composite case part intended for a conditioning-sampling case with refill and cladding, comprising two case parts, the composite case part having an axis, comprising an internal functional piece and an external cladding piece extended axially. The composite case part further comprises a piece for locking the two case parts using a bayonet type locking assembly.

SUMMARY

The invention proposes a lightweight dispenser applicator allowing mascara refilling, in a simple, secure manner, without mixing product and without dirtying the user's hands.

The subject of the invention is therefore a cosmetic product dispenser applicator, comprising:

a) a container comprising an externally threaded neck and a reservoir extending in an axial direction, provided with a lateral wall and forming a cavity for conditioning a cosmetic product, b) an applicator of the cosmetic product, comprising a head internally threaded so as to cooperate with said neck by screwing to ensure a sealed closure of said container, a rod secured by its upper end to said head and by its lower end to an application element intended to immerse in said container when said head is screwed to said neck, c) a hollow outer shell including at least one opening and inside which said container is reversibly fastened, d) a hollow cover including at least one opening and inside which said applicator of the cosmetic product is reversibly fastened.

In the dispenser applicator according to the invention, the respectively outer and inner surfaces of the container and of the outer shell carry first complementary reversible fastening elements, which are clipping elements cooperating for example at a lower part of the container, the respectively outer and inner surfaces of the applicator and of the cover carry second complementary reversible fastening elements cooperating for example at a lower part of the cover, and the first fastening elements and the second fastening elements are designed so that the hooking force between the container and the outer shell is less than the hooking force between the applicator and the cover.

Thus, this configuration makes it possible, when refilling the product, to preferentially maintain the upper assembly in relation to the lower assembly and thus to guarantee the order of the recharging gestures. The invention makes it possible to use a mascara properly throughout the life of each refill, without it becoming unintentionally separated from the outer shell or the cover. In addition, the refilling of the mascara is made easier and the quantity of plastic material discarded at each end of use of the product is reduced.

The first fastening elements may comprise hooks of the outer shell cooperating with a groove in the lateral wall of the container.

There may be two hooks.

The second fastening elements may comprise a clamp of the cover formed of protuberances and which cooperates with a groove of the applicator.

The protuberances may be of the rice grain type.

The protuberances may be distributed over the inner circumference of the cover and be six in number.

The respectively outer and inner surfaces of the container and of the outer shell may further comprise complementary elements securing in rotation around the axial direction the outer shell and the container.

Said complementary elements may be hollows cooperating with corresponding projections.

The respectively outer and inner surfaces of the applicator and of the cover may further comprise second complementary elements securing in rotation around the axial direction the applicator and the cover.

Said second complementary elements may be axial splines cooperating with corresponding axial projections.

BRIEF DESCRIPTION OF THE DRAWINGS

Other characteristics and advantages of the present invention will appear on reading the detailed description below, of a non-limiting example of implementation, made with reference to the appended figures in which.

DETAILED DESCRIPTION OF THE EMBODIMENTS

A cosmetic product dispenser applicator 1 according to the invention comprises a refill and a cladding structure intended to clad said refill so as to obtain an aesthetic dispenser applicator which complies with the visual standards of the marketed products.

Figure 1:
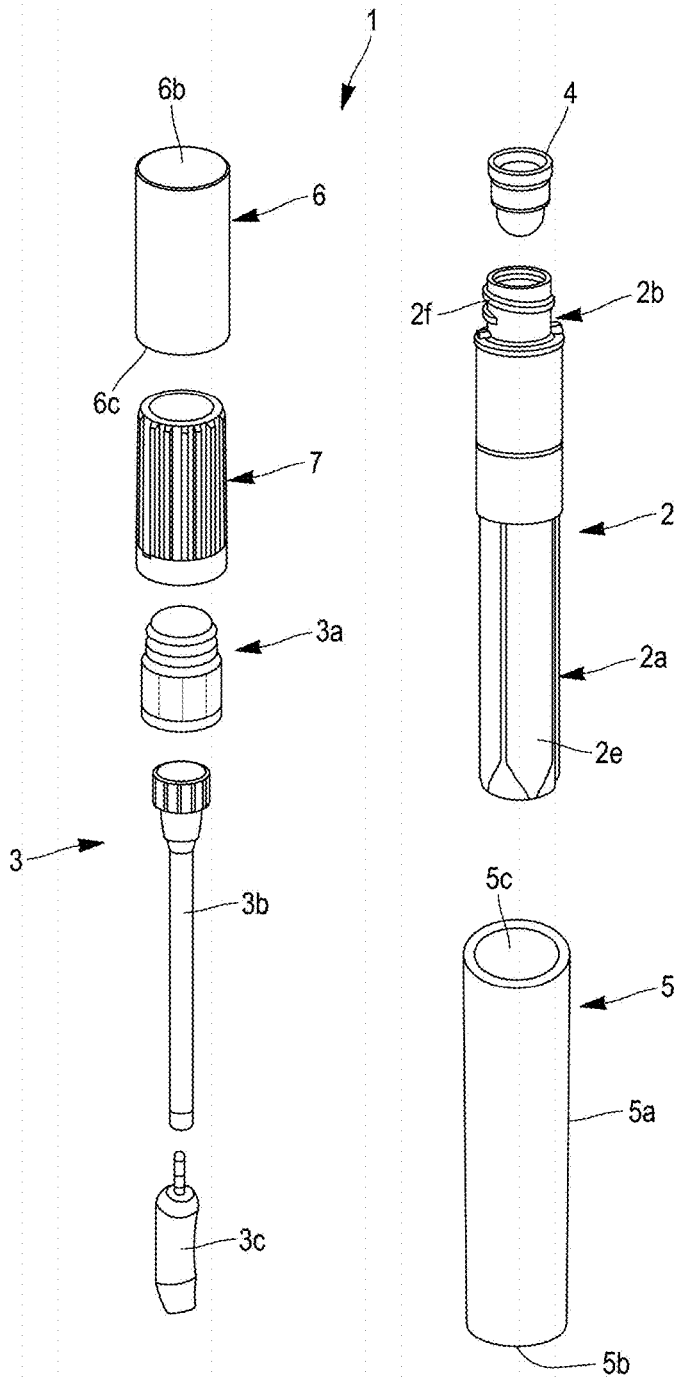
FIG. 1 is an exploded perspective view of a cosmetic product dispenser applicator according to the invention.

As illustrated in FIG. 1, the refill comprises a container 2, an applicator 3 and a wiper 4.

The container 2 comprises a reservoir 2*a* forming a cavity for conditioning the cosmetic product, the reservoir 2*a* extending in an axial direction and including a lateral wall 2*e* and at its so-called upper end an externally threaded neck 2*b*.

The applicator 3 of the cosmetic product comprises a head 3*a* internally threaded so as to cooperate with the neck 2*b* by screwing to ensure a sealed closure of the container 2. The head 3*a* is housed inside an insert 7. A rod 3*b* of the applicator 3 is secured by its upper end to the head 3*a* and by its lower end to an application element 3*c*, typically a brush. The application element 3*c* is typically immersed in the container 2 when the head 3*a* is screwed to the neck 2*b*.

The application element 3*c* may be an application tip comprising a so-called central part cooperating by its end with said rod 3*b* at its lower end, typically by a snap, and a so-called peripheral part capable of sampling a fraction of said product in view of its application. Said application tip may be an application material of cellular or fibrous type secured to a support, or else be a brush comprising a metallic twist as support and a plurality of bristles as application material, or else a molded piece made of plastic material typically comprising a plurality of raised parts or projections, and/or recessed parts or recesses.

The wiper 4 is inserted and blocked by snapping, welding or gluing inside the neck 2*b* of the container 2 and is intended to wipe the application element 3*c* each time the latter is removed from the reservoir 2*a*, so as to regulate the quantity of removed cosmetic product.

The rod 3*b* and the head 3*a* may be integrally formed, for example by molding plastic material. Furthermore, the wiper 4 may also be an integral part of the container 2.

The cladding structure of the dispenser applicator 1 according to the invention comprises an outer shell 5 intended to surround at least the lateral wall of the container 2 and a cap or cover 6 intended to cover the head 3*a* of the applicator 3 and comprising the insert 7.

Figure 4:
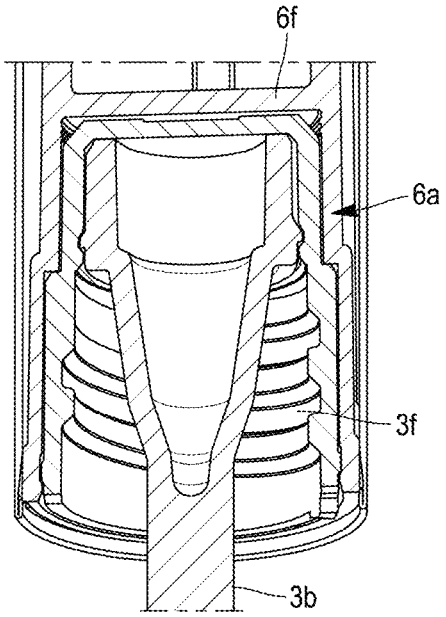
FIG. 4 is a partial view in axial section of the dispenser applicator.
Figure 5:
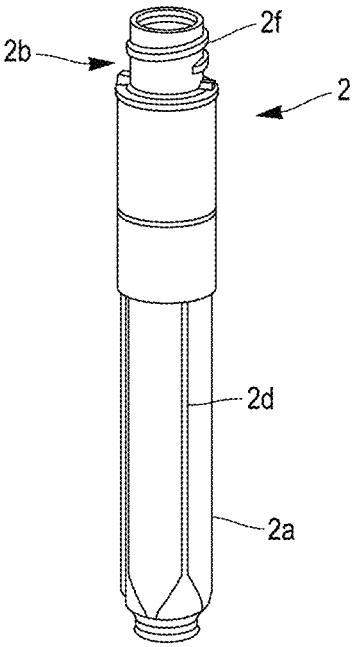
FIG. 5 is a perspective view of a container of the dispenser applicator.
Figure 6:
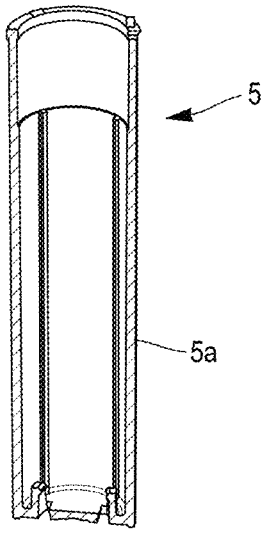
FIG. 6 is a partial perspective view of an outer shell of the dispenser applicator.
Figure 7:
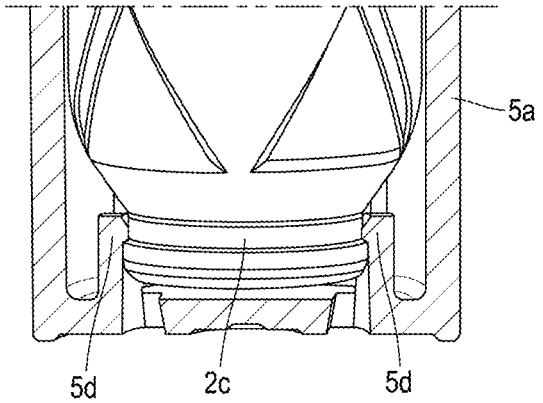
FIG. 7 is a detailed perspective view of the container housed in the outer shell.
Figure 8:
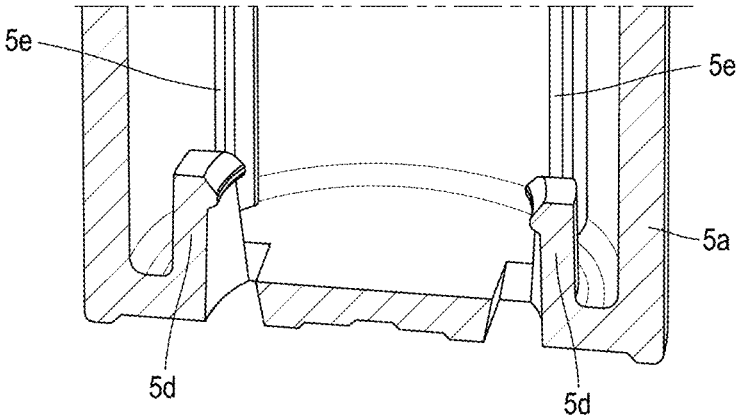
FIG. 8 is a detailed perspective view of the outer shell.

The cap 6 is recessed and more particularly includes a lateral wall 6*a* (FIG. 4), a bottom 6*b* forming the peak of the dispenser applicator 1 and a so-called lower opening 6*c* allowing the insertion of the head 3*a* of the applicator 3 to the inner of the recess.

In the same way, the outer shell 5 is recessed and includes a lateral wall 5*a*, a bottom 5*b* forming the foot of the dispenser applicator 1 and a so-called upper opening 5*c* allowing the insertion of the container 2 inside the recess.

The cladding structure makes it possible to obtain an aesthetic and customizable dispenser applicator. It also serves to hide the visual imperfections resulting from the manufacturing of the refill.

The refill comprised specific characteristics aimed at carrying out the reversible fastening of the applicator 3 and of the container 2 respectively inside the cap 6 and the outer shell 5.

Figure 2:
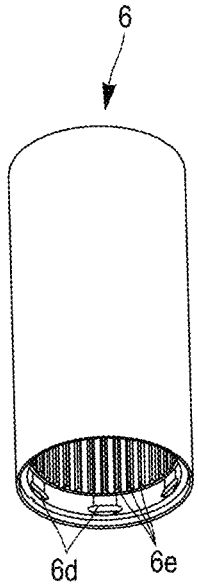
FIG. 2 is a perspective view of a cover of the dispenser applicator.
Figure 3:
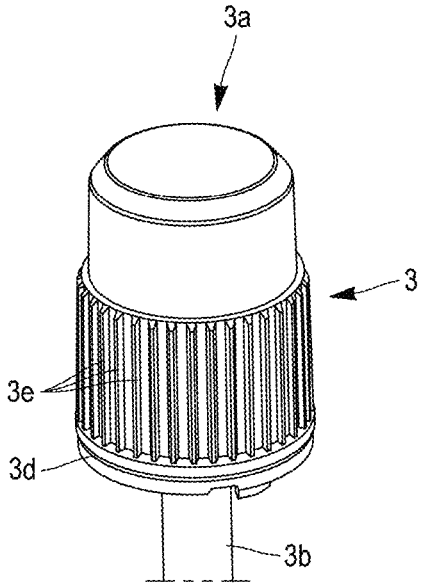
FIG. 3 is a partial perspective view of an applicator of the dispenser applicator.

The head 3*a* of the applicator 3 comprises on its outer lateral surface a clipping element 3*d* cooperating by axial assembly with a complementary clipping element 6*d* arranged on the inner surface of the lateral wall 6*a* of the cap 6, the two clipping elements 3*d*, 6*d* forming a reversible axial fastening means (FIGS. 2 and 3). More particularly, this reversible fastening is carried out by clipping after a translation movement in the axial direction of the head 3*a* relative to the cap 6. The head 3*a* of the applicator 3 also includes on its outer lateral surface an anti-rotation element 3*e* cooperating after insertion of the head 3*a* in the cap 6 with a complementary anti-rotation element 6*e* arranged on the inner surface of the lateral wall 6*a* of the cap 6, the two anti-rotation elements 3*e*, 6*e* forming an anti-rotation system and securing in rotation around the axial direction the cap 6 and the applicator 3.

The reversible axial fastening elements and the anti-rotation system for assembling the applicator and the cap are of the male/female or bead/groove type.

In particular, the clipping element of the applicator 3 comprises a groove 3*d* which may extend continuously all around the applicator 3 and on which a clamp of the cap grips comprising protuberances 6*d* in the shape of rice grains, for example six in number, distributed over the inner circumference of the cap 6 and projecting radially beyond the inner surface of the lateral wall 6*a*. The protuberances 6*d* are intended to clip into the groove 3*d* of the applicator 3. The clipping is preferably performed in a lower area of the cap 6.

The anti-rotation element of the applicator 3 consists of a plurality of projections 3*e*, distributed over the circumference of the head 3*a* and extending radially beyond the outer lateral surface of the head 3*a* and in the axial direction, and the anti-rotation element of the cap 6 consists of a plurality of grooves 6*e*, distributed over the inner circumference of the lateral wall 6*a*, extending in the axial direction and hollowed out radially in the inner surface of the lateral wall 6*a*.

Thus, when the head 3*a* of the applicator 3 is inserted into the cap 6, the protuberances 6*d* engage in the groove 3*d* and the projections 3*e* engage in the grooves 6*e*.

As illustrated in FIGS. 5 to 8, the container 2 includes on the outer surface of its lateral wall 2*e*, at the lower end of the lateral wall 2*e*, a clipping element 2*c* cooperating by axial assembly with a complementary clipping element 5*d* arranged on the inner surface of the lateral wall 5*a* of the outer shell 5, the two clipping elements 2*c*, 5*d* forming a reversible axial fastening means. More particularly, this reversible fastening is carried out by clipping after a translation movement in the axial direction of the container 2 relative to the outer shell 5.

The container 2 also includes on the outer surface of its lateral wall 2*e* an anti-rotation element 2*d* cooperating after insertion of the container 2 in the outer shell 5 with a complementary anti-rotation element 5*e* arranged on the inner surface of the lateral wall 5*a* of the outer shell 5, the two anti-rotation elements 2*d*, 5*e* forming an anti-rotation system and securing in rotation around the axial direction the outer shell 5 and the container 2, that is to say preventing the relative rotation of the outer shell 5 around the container 2 around said axial direction.

The fastening means and the anti-rotation systems for assembling the container 3 of the outer shell 5 are of the male/female or bead/groove type.

The clipping element of the outer shell 5 is constituted by hooks 5*d*, for example two in number, and the clipping element of the container 2 is constituted by a groove or annular channel 2*c* hollowed out radially in the inner surface of the lateral wall 2*e* and extending over the entire inner circumference of the outer shell 5 at the lower end of the lateral wall 2*e*.

The anti-rotation element of the outer shell 5 is constituted by a plurality of projections 5*e*, distributed over the inner circumference of the lateral wall 5*a* and extending radially beyond the inner circumference of the lateral wall 5*a* and in the axial direction, and the anti-rotation element of the container 2 is constituted by a plurality of grooves 2*d*, distributed over the inner circumference of the lateral wall 2*e*, extending in the axial direction and hollowed out radially in the outer surface of the lateral wall 2*e*.

When the container 2 is inserted into the outer shell 5, the end of the hooks 5*d* engage in the groove 2*c* and the projections 5*e* engage in the grooves 2*d* so as to prevent any rotation around the axial direction of the container relative to the outer shell 5.

The head 3*a* of the applicator 3 includes an inner thread 3*f* (FIG. 4) which is screwed onto an outer thread 2*f* formed on the neck 2*b*. A wiper 4, more particularly made of polyethylene or elastomeric material, is fastened inside the neck 2*b* and the head 3*a* of the applicator 3 comes to bear on the wiper 4 when the applicator 3 is screwed onto the container 2 so as to perform a sealed closure of the reservoir 2*a*. The head 3*a* of the applicator 3 is inserted into the cap 6 through the lower opening 6*c* of the cap 6 until the axial fastening elements 3*d*, 6*d* clip. An axial stop 6*f* may also be formed in the cap 6 so as to avoid a too deep insertion of the head 3*a* in the cap 6. The container 2 is inserted into the outer shell 5 through the upper opening 5*c* of the outer shell 5, bottom of the container 2*a* first, until the axial fastening elements 2*c*, 5*d* clip, so as to allow the neck 2*b* to extend above the upper opening 5*c*.

Once assembled, the cap 6 and the applicator 3, respectively the outer shell 5 and the container 2, are perfectly secured together, that is to say they do not undergo any movement relative to each other, until the user decides to separate them. Also, during routine handling of the dispenser applicator 1, such as opening or closing the dispenser, the user grasps the cap 6 on the one hand, and the outer shell 5 on the other hand, and exerts a relative rotational movement around the axial direction of the cap 6 relative to the outer shell 5. Due to the anti-rotation systems, this translation movement is fully transmitted to the applicator 3 and to the container 2 so that the latter are screwed or unscrewed.

To separate the refill from the cladding structure, for example in order to change the refill, the user grasps the cap 6 on the one hand and the outer shell 5 on the other hand while the dispenser applicator 1 is in the closed position, which advantageously avoids any unwanted dirt, and exerts a traction in the axial direction.

The hooking force between the cap 6 and the applicator 3 is greater than the hooking force between the outer shell 5 and the container 2, so that it is the outer shell 5 which separates first from the container 2, that is to say that the fastening elements 5*d*, 2*c* disengage.

The user then grasps the cap 6 on the one hand and the container 2 on the other hand, which provides a substantial grip, and again exerts a traction in the axial direction. The cap 6 then separates from the applicator 3, that is to say the fastening means 6*d*, 3*d* disengage. It is then possible to install a new refill inside the cladding structure or to install the refill just removed on another cladding structure. We then clip the new refill into the outer shell 5, then we clip the cap 6 onto the new refill.

The advantage of the dispenser applicator according to the invention is its simplicity, its limited number of pieces and its durability. The fragile parts of the clipping systems are on disposable refills. The design of the hooks holds the container at the bottom and allows manufacturing without adding material or special movements in the injection mold, demolding being natural. In addition, the hooks are not exposed to shocks during the life of the product, which makes the system robust. Finally, there is a differentiation between the opening gesture of the dispenser applicator, which is a rotation, and the refill gesture, which is a traction of the different elements.

Figure 9:
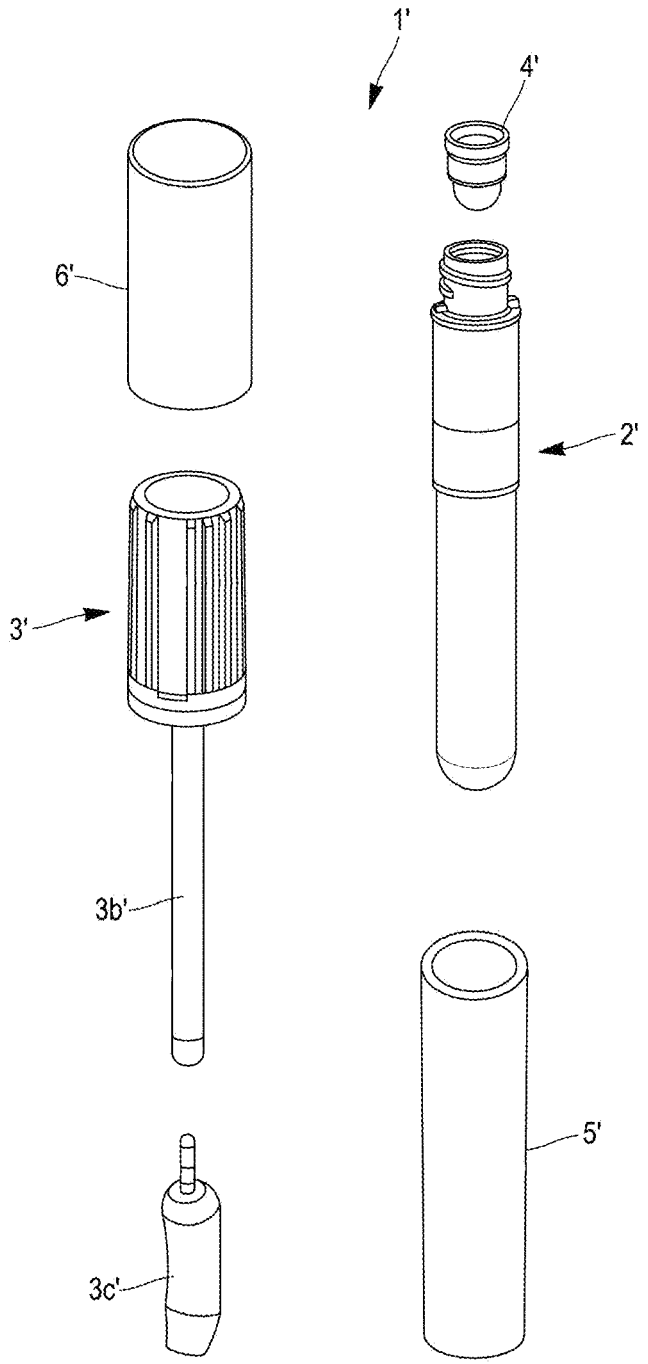
Fig. 9 (prior art)
FIG. 9 is an exploded perspective view of a cosmetic product dispenser applicator of the state of the art.

FIG. 9 illustrates a dispenser applicator 1' of the state of the art. In this type of dispenser, all of the elements are discarded, namely the cap 6', the applicator 3' (4.27 g of poly(butylene terephthalate)) provided with the rod 3*b'*, the application element 3*c'* (0.25 g), the wiper 4' (0.4 g of low density polyethylene), the container 2' (4 g of polypropylene), and the outer shell 5' (6.1 g of acrylonitrile butadiene styrene), which represents a total of 15.02 g of discarded plastic material.

By comparison, with an dispenser applicator 1 of the invention, a total of 7.35 g of plastic material are discarded (the insert 7 (1 g of polypropylene), the rod 3*b* (1.7 g of poly(butylene terephthalate)), the application element 3*c* (0.25 g) the wiper 4 (0.4 g of low density polyethylene), and the container 2 (4 g of polypropylene)).

The dispenser applicator according to the invention thus makes it possible to halve the weight of discarded plastic material, at each refill.

The invention claimed is:

1. A cosmetic product dispenser applicator, comprising:

a) a container comprising an externally threaded neck and a reservoir extending in an axial direction, provided with a lateral wall and forming a cavity for conditioning a cosmetic product, b) an applicator of the cosmetic product comprising a head internally threaded so as to cooperate with said neck by screwing to ensure a sealed closure of said container, a rod secured by its upper end to said head and by its lower end to an application element intended to immerse in said container when said head is screwed to said neck, c) a hollow outer shell including at least one opening and inside which said container is reversibly fastened, and d) a hollow cover including at least one opening and inside which said applicator of the cosmetic product is reversibly fastened, wherein the dispenser applicator comprises respective outer and inner surfaces of the container and of the outer shell that carry first complementary reversible fastening elements, which are clipping elements cooperating at a lower part of the container, wherein respective outer and inner surfaces of the applicator and of the cover carry second complementary reversible fastening elements cooperating at a lower part of the cap, and wherein the first fastening elements and the second fastening elements are designed in such a way that a hooking force between the container and the outer shell is less than a hooking force between the applicator and the cover.

2. The dispenser applicator according to claim 1, wherein the first fastening elements comprise hooks of the outer shell cooperating with a groove of the lateral wall of the container.

3. The dispenser applicator according to claim 2, wherein the hooks are two in number.

4. The dispenser applicator according to claim 1, wherein the second fastening elements comprise a clamp of the cover formed of protuberances and which cooperates with a groove of the applicator.

5. The dispenser applicator according to claim 4, wherein the protuberances are of a rice grain type.

6. The dispenser applicator according to claim 4, wherein the protuberances are distributed over an inner circumference of the cover and are six in number.

7. The dispenser applicator according to claim 1, wherein the respective outer and inner surfaces of the container and of the outer shell further comprise complementary elements securing in rotation around the axial direction the outer shell and the container.

8. The dispenser applicator according to claim 7, wherein said complementary elements are grooves cooperating with corresponding projections.

9. The dispenser applicator according to claim 1, wherein the respective outer and inner surfaces of the applicator and of the cover further comprise second complementary elements securing in rotation around the axial direction the applicator and the cover.

10. The dispenser applicator according to claim 9, wherein said second complementary elements are axial splines cooperating with corresponding axial projections.

* * * * *